United States Patent [19]

Yancey

[11] Patent Number: 5,046,729

[45] Date of Patent: Sep. 10, 1991

[54] BASEBALL PITCHERS PRACTICE TARGET

[76] Inventor: William E. Yancey, 8741 South Justine, Chicago, Ill. 60620

[21] Appl. No.: 581,378

[22] Filed: Sep. 12, 1990

[51] Int. Cl.[5] ..... A63B 69/00

[52] U.S. Cl. ..... 273/26 A; 273/181 J; 273/374; 273/376; 273/377; 273/378; 273/386; 273/410

[58] Field of Search ..... 273/26 R, 26 A, 29 A, 273/371, 408, 348, 378, 181 J, 181 H, 374, 375, 376, 373, 378, 379, 386, 377; 250/222.2, 221

[56] References Cited

U.S. PATENT DOCUMENTS

| | | | |
|---|---|---|---|
| 476,334 | 6/1892 | Ullman . | |
| 939,024 | 11/1909 | Hire . | |
| 941,828 | 11/1909 | Voller . | |
| 2,040,228 | 10/1935 | Whiteley | 273/26 |
| 2,523,773 | 9/1950 | Metzger | 273/408 |
| 2,784,001 | 3/1957 | Simjian | 273/374 |
| 3,082,005 | 3/1967 | Kron | 273/375 |
| 3,133,733 | 5/1964 | Elseroad | 273/88 |
| 3,206,196 | 11/1962 | Jackson | 273/26 |
| 3,229,975 | 1/1966 | Tompkins et al. | 273/26 |
| 3,254,433 | 6/1966 | Saile Jr.; et al. | 273/374 |
| 3,814,438 | 6/1974 | Baron et al. | 273/181 H |
| 3,970,310 | 1/1976 | Gryschuk | 273/375 |
| 4,070,018 | 1/1978 | Hodges | 273/379 |
| 4,199,141 | 4/1980 | Garcia | 273/26 A |
| 4,563,005 | 1/1986 | Hand | 273/371 |
| 4,770,527 | 9/1988 | Park | 273/26 A |
| 4,830,369 | 5/1989 | Poitras | 273/376 |

*Primary Examiner*—Theatrice Brown

*Attorney, Agent, or Firm*—Juettner Pyle & Lloyd

[57] ABSTRACT

The apparatus of the invention comprises a backboard; a matrix of panels representing a strike zone; springs for resiliently biasing each of the panels outwardly from the backboard; switches mounted to the backboard behind the panels, whereby the impact of a pitched ball will move the panel inwardly towards the backboard causing the switch to momentarily close; a horizontal array of red, yellow and green lamps mounted to the backboard adjacent the top of the backboard, one lamp in vertical alignment with each of the columns of panels; a left vertical array of red, yellow and green lamps mounted to the backboard adjacent the left edge of the backboard, one lamp in horizontal alignment with each row of panels; a right vertical array of red, yellow and green lamps mounted to the backboard adjacent the right edge of the backboard, a power source; and electrical wiring to connect the power source, switches and lamps. When a baseball hits a left or right side panel the lamp in vertical alignment with the panel and the lamp horizontally adjacent the panel will light. If a center panel is hit, the lamp in vertical alignment with the panel will light and both lamps in horizontal alignment with the panel will light.

20 Claims, 3 Drawing Sheets

Fig. 1.
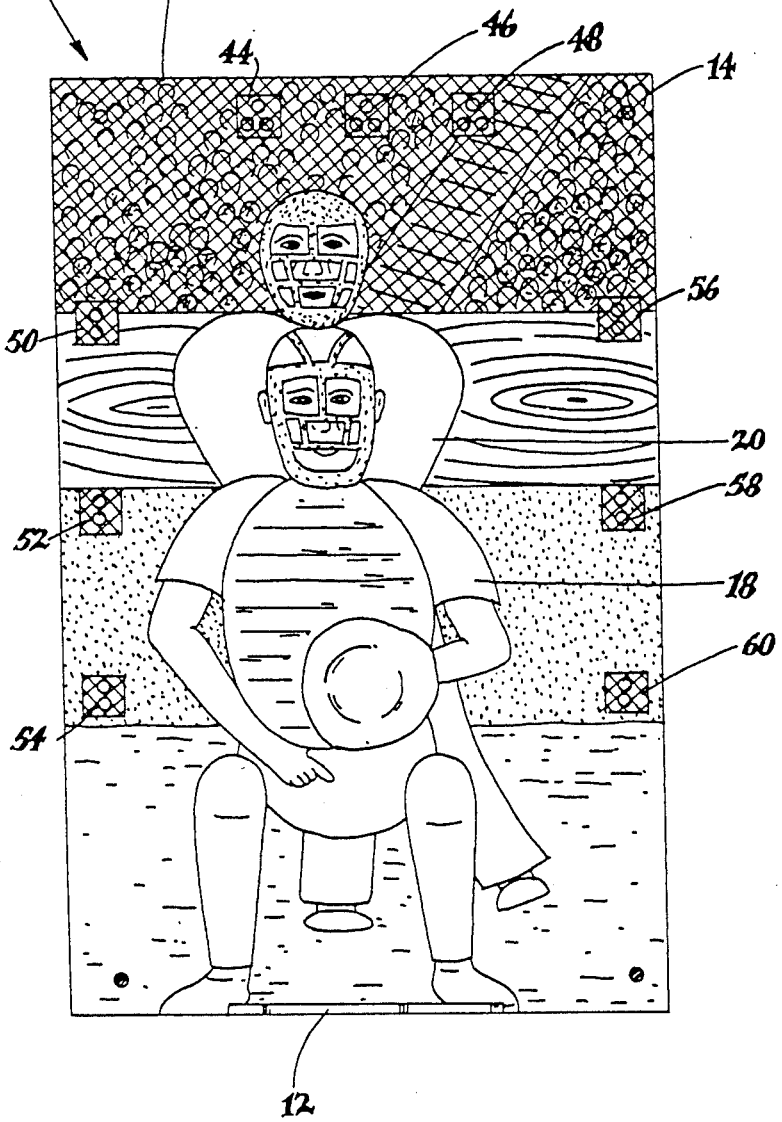
Fig. 3.
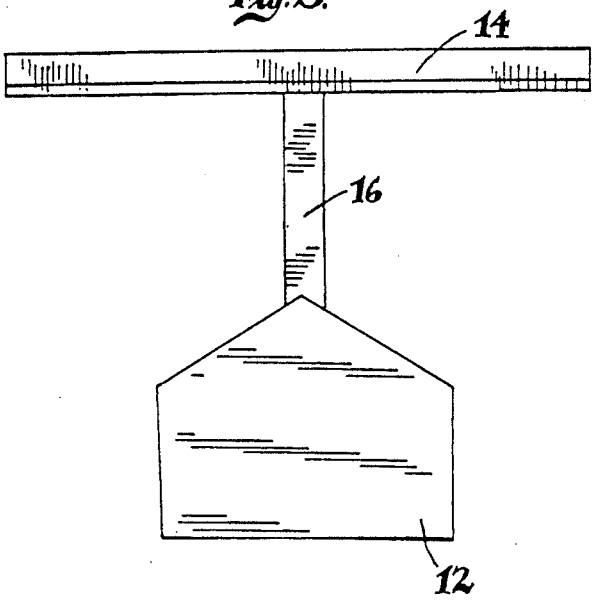
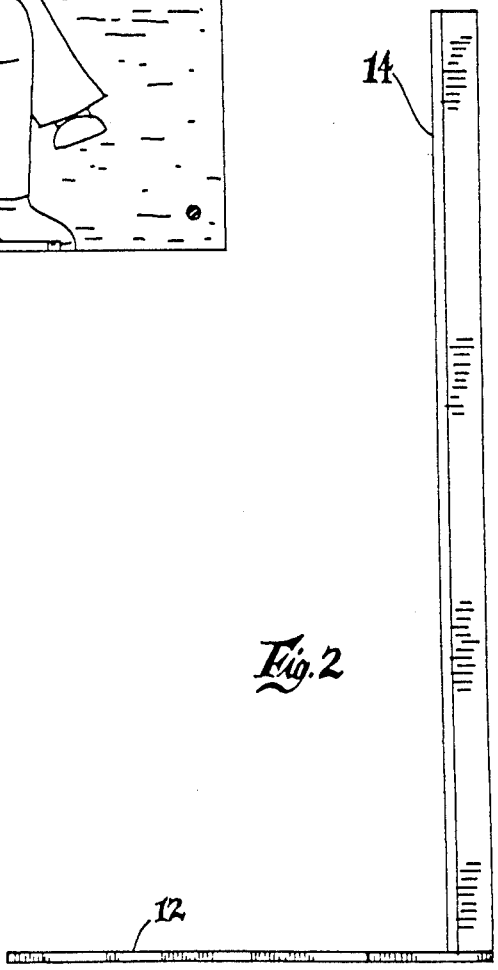
Fig. 2

BASEBALL PITCHERS PRACTICE TARGET

BACKGROUND OF THE INVENTION

The present invention relates to baseball game devices and more particularly to baseball pitching skill evaluation apparatus.

It has long been desired to provide a baseball pitching skill evaluation device that would indicate whether a pitched ball constitutes a "strike" or "ball," within the rules of the game of baseball. With such an apparatus, one could practice pitching baseballs to hone one's skill. It could also be used as a game device for amusement. Over the years, many efforts have been made in the art to provide such a device. See, for example:

U.S. Pat. No. 476,334 to M. Ullman
U.S. Pat. No. 939,024 to H. E. Hire
U.S. Pat. No. 941,828 to J. A. & L. Voller
U.S. Pat. No. 2,040,228 to F. A. Whiteley
U.S. Pat. No. 3,133,733 to D. C. Elseroad
U.S. Pat. No. 3,206,196 to C. E. Jackson
U.S. Pat. No. 3,229,975 to P. S. Tompkins, et al Nevertheless, the art has not as yet fully and adequately developed the baseball pitching skill evaluator apparatus. For example, some of the prior art devices require manual operation to reset the device after each ball has been pitched.

OBJECTS OF THE INVENTION

It is an object of the invention to provide an apparatus that will accurately indicate whether a pitched baseball constitutes a strike within the rules of the game of baseball.

It is a further object of the invention to provide an apparatus that will indicate the particular location of the strike. More specifically, it is an object that the device indicate each of nine positions wherein a pitched ball may properly be called a strike, namely, shoulder high outside corner, shoulder high down the center, shoulder high inside corner, waist high outside corner, waist high down the center, waist high inside corner, knee high outside corner, knee high down the center, and knee high inside corner.

It is another object of the invention that the apparatus be automatic, with no need for operator assistance.

It is yet a further object of the invention to provide an apparatus that includes indicator lamps of various colors and positions so that game participants may readily recognize and know the position of the pitched baseball.

It is a final object of the invention that the apparatus be easily and inexpensively made.

SUMMARY OF THE INVENTION

The foregoing objects are achieved by the present invention, which is a baseball pitching skill evaluator and game apparatus relating to the game of baseball and the art of pitching. It has been developed for baseball pitching skill evaluation, for practice, and for play. The apparatus comprises a backboard; a resilient cover attached to the backboard having a target painted thereon, the target depicting a catcher, an umpire and spectators seated in the stands; a three-by-three matrix of panels movably attached to the backboard underlying the cover, the matrix of panels being between knee and shoulder height of a batter and representing a strike zone; springs for resiliently biasing each of the panels outwardly from the backboard; switches mounted to the backboard behind the panels, whereby the impact of a pitched ball to the cover overlying a panel will move the panel inwardly towards the backboard causing the switch to momentarily close, where after the switch will re-open as a result of the springs moving the panel outwardly from the backboard; a horizontal array of red, yellow and green lamps mounted to the backboard adjacent the top of the backboard, one lamp in vertical alignment with each of the columns of panels; a left vertical array of red, yellow and green lamps mounted to the backboard adjacent the left edge of the backboard, one lamp in horizontal alignment with each row of panels; a right vertical array of red, yellow and green lamps mounted to the backboard adjacent the right edge of the backboard, again one lamp in horizontal alignment with each row of panels; a power source; and electrical wiring to connect the power source, switches and lamps so that when a baseball impacts with a panel the lamps in horizontal and vertical alignment with the struck panel will light to indicate the area of the strike zone in which the baseball was thrown. In practice, a pitcher can throw any pitch of his choice and have an indication of what region of the strike zone the pitch landed.

Another use of my game apparatus is to see how many batters a person can strike out using six pitches to constitute a strikeout or a walk. Three pitches of the six pitches striking the target over the home plate within the imaginary strike zone, which would be between the arm pits and knees of a batter if he was standing there, would constitute a strikeout. Four pitches of the six pitches missing the strike zone of the target would constitute a walk as in the game of baseball. Eighteen pitches at the target would be symbolic of one inning. One person or more can enjoy pitching at the baseball pitching skill evaluator and game apparatus of the invention, each person pitching eighteen baseballs at the target which would constitute one complete inning. The game can also be enjoyed with each person pitching six pitches apiece which would constitute a strikeout or a walk. In this case, the winner of the game would be the party with the most strikeouts.

Further objects and advantages of the present invention will become apparent from the following detailed description when read in reference to the accompanying drawings.

DESCRIPTION OF THE DRAWINGS

FIG. 1 is a front elevational view of the baseball pitching skill evaluator and game apparatus of the invention.

FIG. 2 is a right side elevational view of the baseball pitching skill evaluator and game apparatus of the invention.

FIG. 3 is a top plan view of the baseball pitching skill evaluator and game apparatus of the invention.

DETAILED DESCRIPTION

Figure 4:
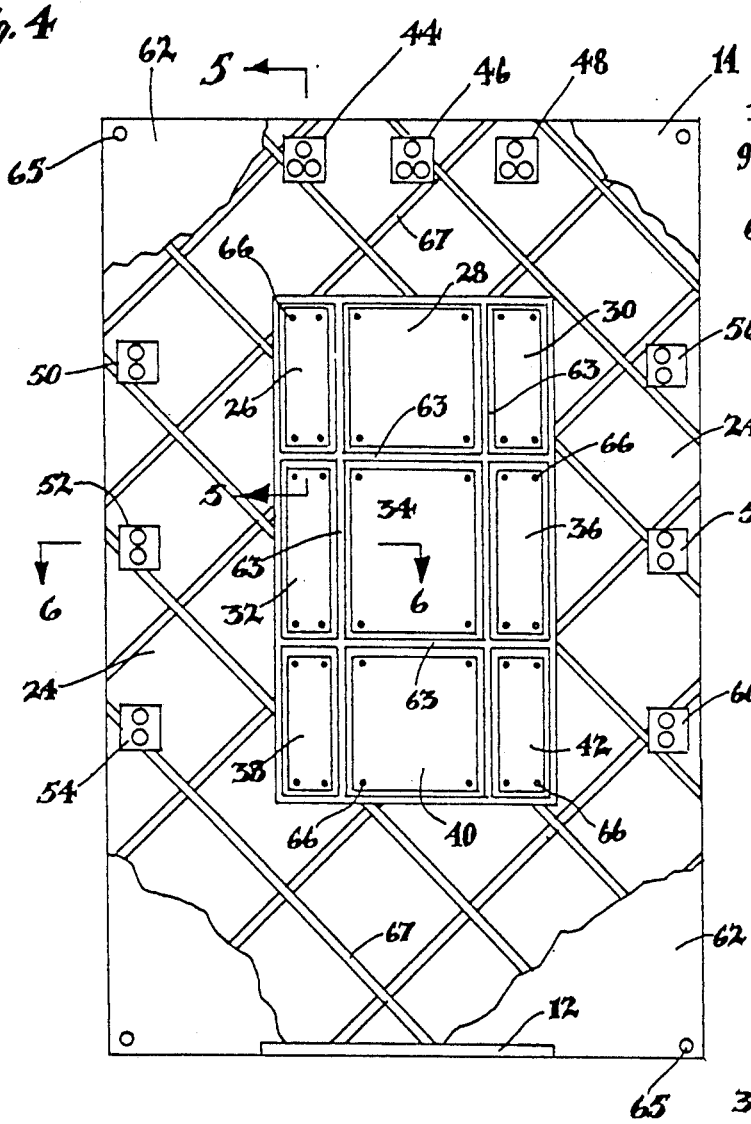
FIG. 4 is a front elevational view of the apparatus of the invention similar to FIG. 1, but with the outer cover partially removed, illustrating the internal panels of the invention.

Turning now to the drawings, particularly FIGS. 1-3, a baseball pitching skill evaluator and game apparatus 10 of the invention is shown. The apparatus 10 comprises a home plate 12, a target 14 and a member 16 connecting home plate 12 to target 14. Member 16 is preferably adjustably attached to target 14 so that one may adjust the relative distance between the plate 12 and target 14. On the front surface of the target 14 is depicted a scene typically seen by a pitcher, namely a catcher 18, umpire 20 and spectators 22.

Figure 5:
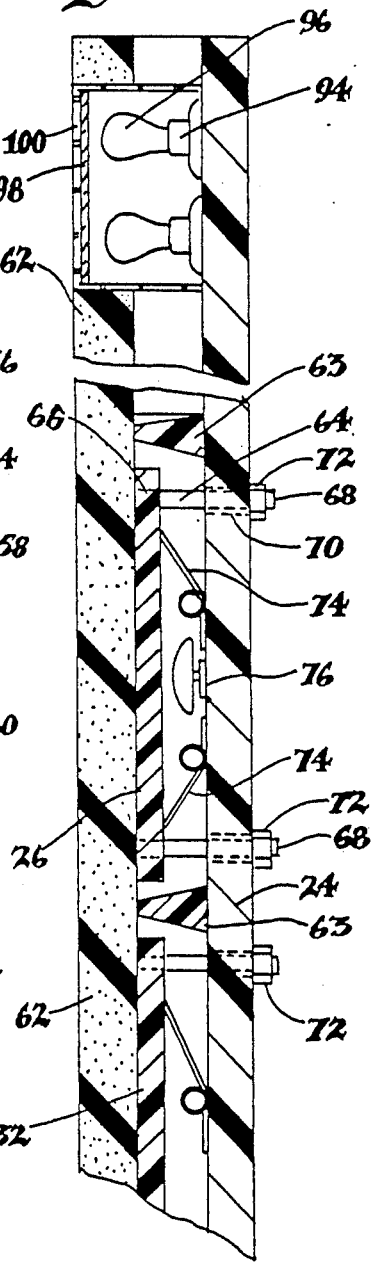
FIG. 5 is a partial vertical section taken along line 5—5 of FIG. 4.
Figure 6:
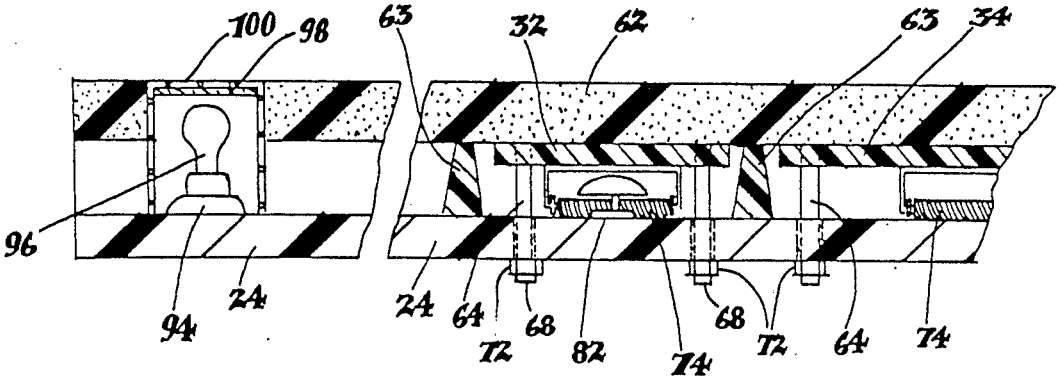
FIG. 6 is a partial horizontal section taken along line 6—6 of FIG. 4.

Turning now to FIGS. 4-6, the target 14 comprises a backboard 24, nine panels 26, 28, 30, 32, 34, 36, 38, 40, 42 movably mounted to the backboard 24, a horizontal array of lamps 44, 46 and 48, a left vertical array of lamps 50, 52 and 54, a right vertical array of lamps 56, 58 and 60, and a cover 62. The backboard 24 may be made from any durable, rigid material. Molded plastic is preferred, however, because of its light weight.

The cover 62 comprises a smooth, tough and flexible outer layer and a cushioned inner layer, e.g., foam rubber. The cover 62 may be fastened to the backboard in any conventional manner, mechanical fasteners 65 being shown. The cover 62, in areas other than the panel area, is supported by lattice members 67.

The strike zone in the game of baseball is the width of the plate, seventeen inches horizontal, and the height between the batter's knees and shoulders, approximately thirty-three inches vertical. In the present invention the strike zone is comprised of the nine panels 26, 28, 30, 32, 34, 36, 38, 40, 42 arranged in a three-by-three matrix. The matrix may be defined as having three horizontal rows and three vertical columns. It is desirable to make the center column panels 28, 34, 40 substantially wider than the side column panels 26, 30, 32, 36, 38, 42. In one embodiment, the panels in both the left and right side columns are each three inches wide and the panels in the center column are eight inches wide. This leaves a one and one-half inch space between each column of panels. The vertical height of each panel is preferable equal. In the one embodiment, the vertical height of all panels is ten inches, thereby again leaving a one and one-half inch space between each row of panels.

The panels 26 through 42 are each movably mounted to backboard 24 by four pegs 64 per panel. One end of each peg 64 is secured to each panel at the panel corners 66. The other end 68 of the peg 64 passes through openings 70 in backboard 24. The end of each peg 64 is preferably fitted with a stop 72 to limit the outward movement of the panel. The stop 72 may comprise a threaded nut having a outside dimension greater than the inside dimension of openings 70. The panels are preferably molded from a rigid, durable plastic, as is preferred for the backboard.

The panels 26 through 42 are separated by members 63. Members 63 have a trapezoidal cross section as may be seen in FIGS. 5 and 6. The purpose of members 63 is to divert a baseball pitched in to an area between two or more panels to one panel or another, thereby preventing the baseball from hitting more than one panel.

Between each panel 26 through 42 and backboard 24 are positioned springs 74 for biasing each panel outwardly from the backboard 24. The springs 74 may be of any conventional type, but conventional mouse trap springs have been found to perform satisfactorily. The narrower left and right column panels 26, 30, 32, 36, 38 and 42 are preferably fitted with two springs each, one top, another bottom. The wider center column panels 28, 34 and 40 are preferably fitted with four springs each, two side-to-side at top and another two side-to-side at bottom.

Between each panel 26 through 42 and backboard 14 is a switch, which have been numbered 76 through 92, respectively. The switches 76 through 92 are electrically connected to a suitable power source and lamp arrays 44 through 60 in a particular fashion as will yet be fully described. The switches preferably comprise spring loaded, slide switches. The head of each switch is spaced slightly from the back surface of each panel, so that the switch will not be closed inadvertently. In a preferred embodiment, the springs 74 have a greater outward dimension when fully compressed than the switches when they are fully compressed. Thereby, the springs cooperate as stops to prevent over compression of the switches, which could damage or break the same. Accordingly, when a pitched ball strikes a panel, the force of the ball will overcome the force of the springs 74, moving the panel inwardly towards the backboard. The panel will then contact the switch causing the switch to momentarily close. The force of the springs 74 will then take over, moving the panel back to its original position. Likewise, the internal spring in the switch will return the switch to its normal, open position.

The power source may direct current batteries, e.g., conventional 9 volt dry cells, or alternatively may be household current, i.e., 110 volt alternating current It has been found convenient to use nine 9 volt batteries, one for each switch. In this manner, the batteries are not heavily burdened and accordingly last a long time.

The lamp arrays 44 through 60 comprise plural conventional light fixtures 94 and bulbs 96, appropriate for the type of current selected. Seven volt direct current bulbs have been found to perform satisfactorily with 9 volt dry cells. The fixtures 94 may be mounted to the backboard 24 in any conventional manner.

Each lamp 44 through 60 is covered with a colored lens 98 so as to assist in indicating the location of a given pitched ball. Preferably, the horizontal lamp array 44, 46 and 48 are fitted with red, yellow and green lenses, respectively. The left vertical lamp array 50, 52 and 54 are fitted with red, yellow and green lenses, respectively. Likewise, the right vertical lamp array 56, 58 and 60 are fitted with red, yellow and green lenses, respectively. In addition, each lens 98 is covered with a wire guard 100 to protect the lens and bulb from being struck and potentially damaged by a pitched ball.

Figure 7:
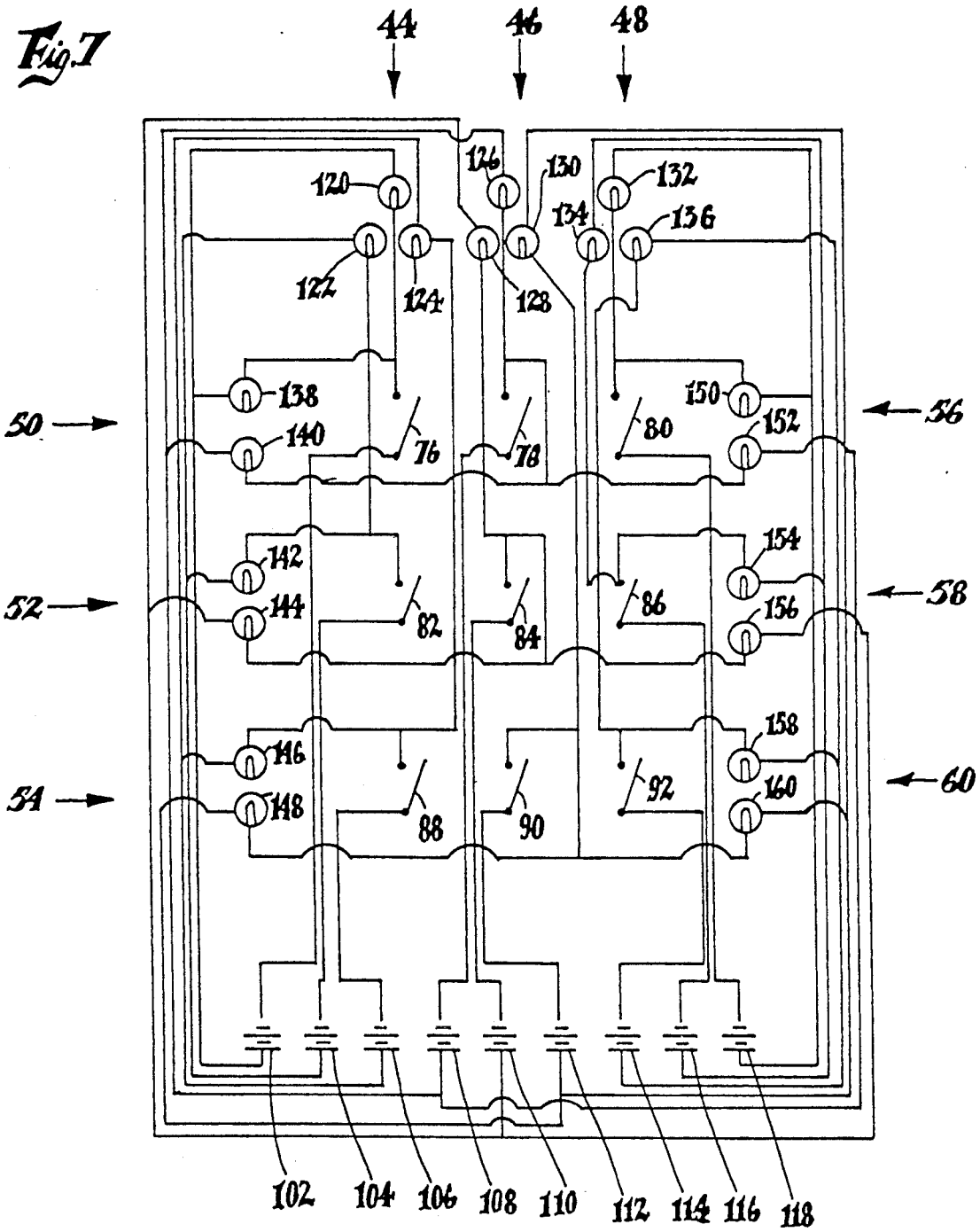
FIG. 7 is an electrical wiring diagram of the apparatus of the invention.

Turning now to FIG. 7, a representative wiring diagram for the apparatus of the invention is shown. Nine batteries 102 through 118 are provided, one for each panel switch 76 through 92. Each lamp 44 through 60 comprises plural bulbs. Specifically, lamp 44 comprises bulbs 120, 122 and 124. Lamp 46 comprises bulbs 126, 128 and 130. Lamp 48 comprises bulbs 132, 134 and 136. Lamp 50 comprises bulbs 138 and 140. Lamp 52 comprises bulbs 142 and 144. Lamp 54 comprises bulbs 146 and 148. Lamp 56 comprises bulbs 150 and 152. Lamp 58 comprises bulbs 154 and 156. Lamp 60 comprises bulbs 158 and 160. As can be seen from the FIG. 7 diagram closing any of the the left side switches 76, 82 or 88 will cause one of three bulbs in lamp 44 to light and will cause one of the bulbs in the left side lamp array 50, 52 and 54, respectively, horizontally adjacent the particular switch, to light. Thus, closing switch 76 will cause bulb 120 in lamp 44 and bulb 138 in lamp 50 to light. Similarly, closing switch 82 will cause bulb 122 in lamp 44 and bulb 142 in lamp 52 to light. Closing switch 88 will cause bulb 124 in lamp 44 and bulb 146 in lamp 54 to light. On the right side, closing any of the right side switches 80, 86 and 92 will cause one of the bulbs in lamp 48 above the switch to light and will cause one of the bulbs in the lamp array 56, 58 and 60, respectively, horizontally adjacent the particular switch to light as well. Thus, for example, closing switch 86 will cause bulb 134 in lamp 48 and bulb 154 in lamp 58 to light. Closing any of the center switches 78, 84 and 90 will cause one of the bulbs in lamp 46, vertically above the switch to light. In addition, closing of any of the center switches will cause a bulb in both the left and right lamp arrays, horizontally adjacent the particular switch to light. Thus, closing switch 78 will cause three bulbs to light, namely bulb 126 in lamp 46, bulb 140 in lamp 50 and bulb 152 in lamp 56. Similarly, closing switch 84 will light bulb 128 in lamp 46, bulb 144 in lamp 52 and bulb 156 in lamp 58. Finally, closing switch 90 will light bulbs 130, 148 and 160 in lamps 46, 54 and 60, respectively.

Alternative ways of electrically wiring the apparatus of the invention will undoubtedly occur to those skilled in the art. The description herein contained is merely illustrative and is not intended to limit the scope of the claimed invention.

Accordingly, in application, a person pitches a ball in the direction of target 14. If the pitched ball strikes the target in the area of the nine panels 26 through 42, thereby constituting a strike, the panel underlying the foam cover 62 that has been hit will move inwardly towards the backboard 24 by the force of the pitched ball, depressing springs 74. This in turn will cause the switch underlying the panel to be closed completing the circuit to light the appropriate lamps and thereby indicate the location of the pitch. More specifically, for example, if the area of cover 62 overlying panel 30 is struck by a pitched ball, green lamp 48 and red lamp 56 will light, indicating a pitch to the upper inside corner to a right-handed batter. A pitch to cover in the area panel 34 will light yellow lamp 46 and yellow lamps 52 and 58, indicating a waist high pitch down the middle. A pitch striking the cover 62 in the area of panel 38 will light red lamp 44 and green lamp 54, thereby indicating a pitch to the lower outside corner to a right-handed batter.

It is to be understood that the preferred embodiment of the invention and best mode for practicing the invention presently contemplated have been shown and described, but that various changes and modifications may well be made by those skilled in the art without departing from the scope of the invention as defined in following claims.

What is claimed is:

1. A baseball pitching skill evaluator and game apparatus, comprising:

a) a backboard;

b) a resilient cover attached to and substantially covering a front surface of said backboard, said cover having a target thereon;

c) a matrix of panels movably attached to said backboard underlying said cover, said matrix having left, center and right columns and at least two rows of panels, said matrix of panels being between knee and shoulder height of a batter and representing a strike zone;

d) means for resiliently biasing each of said panels outwardly from said backboard;

e) switch means associated with each of said panels, said switch means normally being in an open position, and whereby the impact of a pitched ball to the cover overlying a said panel will move the panel inwardly towards said backboard causing the associated said switch means to momentarily close, where after the said associated switch means will re-open as a result of the biasing means moving the said panel outwardly from said backboard;

f) a horizontal array of plural lamps mounted to said backboard adjacent the top of said backboard, one lamp of said horizontal array in vertical alignment with each of said columns of panels;

g) a left vertical array of plural lamps mounted to said backboard adjacent the left edge of said backboard, one lamp of said left vertical array in horizontal alignment with each of said rows of panels;

h) a right vertical array of plural lamps mounted to said backboard adjacent the right edge of said backboard, one lamp of said right vertical array in horizontal alignment with each of said rows of panels;

i) a power source;

j) means for electrically connecting each said switch means associated with a said panel in said left column of panels to the lamp in said horizontal array that is in vertical alignment with said left column, and to the respective lamp in said left vertical array that is in horizontal alignment with the respective ones of said panels, whereby movement of any panel in said left column will cause the switch associated with that panel to momentarily close and thereby light the lamp in vertical alignment with that panel and the lamp in said left vertical array that is in horizontal alignment with that panel;

k) means for electrically connecting each said switch means associated with a said panel in said right column of panels to the lamp in said horizontal array that is in vertical alignment with said right column, and to the respective lamp in said right vertical array that is in horizontal alignment with the respective ones of said panels, whereby movement of any panel in said right column will cause the switch associated with that panel to momentarily close and thereby light the lamp in vertical alignment with that panel and the lamp in said right vertical array that is in horizontal alignment with that panel; and l) means for electrically connecting each said switch means associated with a said panel in said center column of panels to the lamp in said horizontal array that is in vertical alignment with said center column, and to the respective lamps in both said left and right vertical arrays that are in horizontal alignment with the respective ones of said panels, whereby movement of any panel in said center column will cause the switch associated with that panel to momentarily close and thereby light the lamp in vertical alignment with that panel and the lamps in horizontal alignment with that panel.

2. An apparatus as in claim 1, further comprising a plurality of pegs attached substantially perpendicular to each of said panels, said backboard having openings corresponding to each of said pegs, said pegs extending freely through said openings.

3. An apparatus as in claim 2, further comprising stop means secured to the end of each said peg for limiting outward travel of said pegs through said openings in said backboard.

4. An apparatus as in claim 1, wherein said panels in said left and right columns are of substantially equal horizontal dimension, and said panels in said center column have a horizontal dimension substantially greater than that of said panels in said left or right columns.

5. An apparatus as in claim 1, wherein said horizontal array of plural lamps further comprise lenses over said lamps, each of said lenses in said horizontal array being different colors.

6. An apparatus as in claim 5, wherein the said lens of said lamp in vertical alignment with said left column is red, the said lens of said lamp in vertical alignment with said center column is yellow, and the said lens of said lamp in vertical alignment with said right column is green.

7. An apparatus as in claim 1, further comprising guards over each of said lamps.

8. An apparatus as in claim 1, further comprising a home plate adjustably attached to said backboard, whereby the distance between said home plate and said backboard may be adjusted.

9. An apparatus as in claim 1, wherein said target on said cover comprises a depiction of a catcher, umpire and spectators.

10. An apparatus as in claim 1, wherein said switch means comprises a spring loaded slide switch per panel, said switch means mounted to said backboard behind each said panel.

11. An apparatus as in claim 1, wherein said means for resiliently biasing comprises a plurality of springs per panel, said springs sandwiched between said backboard and each said panel.

12. An apparatus as in claim 1, wherein said switch means comprises a spring loaded slide switch per panel, said switch means mounted to said backboard behind each said panel; and said means for resiliently biasing comprises a plurality of springs per panel, said springs sandwiched between said backboard and each said panel; each said spring having a greater outward dimension when fully compressed than said switches when fully compressed, whereby said springs cooperate as stops to prevent over compression of said switches.

13. An apparatus as in claim 1, wherein said matrix of panels comprises three said rows of panels, the upper said row corresponding to a baseball batter's shoulders, the center row corresponding to the batter's waist, and the lower row corresponding to the batter's knees.

14. An apparatus as in claim 13, wherein said left vertical array of lamps comprises three lamps, each said lamp corresponding to a respective one of each of said three rows of panels, and each said lamp further comprising a lens over each said lamp, each of said lenses in said left vertical array being different colors.

15. An apparatus as in claim 14, wherein the said lens of said lamp in horizontal alignment with said upper row of panels is red, the said lens of said lamp in horizontal alignment with said center row is yellow, and the said lens of said lamp in horizontal alignment with said lower row is green.

16. An apparatus as in claim 13, wherein said right vertical array of lamps comprises three lamps, each said lamp corresponding to a respective one of each of said three rows of panels, and each said lamp further comprising a lens over each said lamp, each of said lenses in said right vertical array being different colors.

17. An apparatus as in claim 16, wherein the said lens of said lamp in horizontal alignment with said upper row of panels is red, the said lens of said lamp in horizontal alignment with said center row is yellow, and the said lens of said lamp in horizontal alignment with said lower row is green.

18. A baseball pitching skill evaluator and game apparatus, comprising:

a) a backboard;

b) a resilient cover attached to and substantially covering a front surface of said backboard, said cover having a target thereon;

c) a matrix of panels movably attached to said backboard underlying said cover, said matrix having plural columns and plural rows of panels, said matrix of panels being between knee and shoulder height of a baseball batter and representing a strike zone;

d) a plurality of pegs attached substantially perpendicular to each of said panels, said backboard having openings corresponding to each of said pegs, said pegs extending freely through said openings.

e) means for resiliently biasing each of said panels outwardly from said backboard;

f) switch means associated with each of said panels, said switch means normally being in an open position, and whereby the impact of a pitched ball to the cover overlying a said panel will move the panel inwardly towards said backboard causing the associated said switch means to momentarily close, where after the said associated switch means will re-open as a result of the biasing means moving the said panel outwardly from said backboard;

g) a horizontal array of plural lamps mounted to said backboard adjacent the top of said backboard, one lamp of said horizontal array in vertical alignment with each of said columns of panels;

h) a vertical array of plural lamps mounted to said backboard adjacent a side edge of said backboard, one lamp of said vertical array in horizontal alignment with each of said rows of panels;

i) a power source; and j) means for electrically connecting said power source to each of said switch means associated with a said panel and to the lamp in said horizontal array that is in vertical alignment with each respective panel and to the lamp in said vertical array that is in horizontal alignment with each respective panel, whereby movement of any said panel will cause the switch associated therewith to momentarily close and thereby light the lamps in both vertical and horizontal alignment with that panel.

19. An apparatus as in claim 18, wherein said switch means comprises a spring loaded slide switch per panel, said switch means mounted to said backboard behind each said panel; and said means for resiliently biasing comprises a plurality of springs per panel, said springs sandwiched between said backboard and each said panel; each said spring having a greater outward dimension when fully compressed than said switches when fully compressed, whereby said springs cooperate as stops to prevent over compression of said switches.

20. A baseball pitching skill evaluator and game apparatus, comprising:

a) a backboard;

b) a resilient cover attached to and substantially covering a front surface of said backboard, said cover having a target thereon;

c) a matrix of panels movably attached to said backboard underlying said cover, said matrix having plural columns and plural rows of panels, said matrix of panels being between knee and shoulder height of a baseball batter and representing a strike zone;

d) a spring loaded slide switch associated with each said panel, each said switch mounted to said backboard behind each said panel, each said switch normally being in an open position, and whereby the impact of a pitched ball to the cover overlying a said panel will move the panel inwardly towards said backboard causing the associated said switch means to momentarily close;

e) a plurality of springs per each said panel for biasing each said panel outwardly from said backboard, said springs sandwiched between said backboard and each said panel; said springs having a greater outward dimension when fully compressed than said switches when fully compressed, whereby said springs cooperate as stops to prevent over compression of said switches;

f) a horizontal array of plural lamps mounted to said backboard adjacent the top of said backboard, one lamp of said horizontal array in vertical alignment with each of said columns of panels;

g) a vertical array of plural lamps mounted to said backboard adjacent a side edge of said backboard, one lamp of said vertical array in horizontal alignment with each of said rows of panels;

h) a power source; and i) means for electrically connecting said power source to each of said switch means associated with a said panel and to the lamp in said horizontal array that is in vertical alignment with each respective panel and to the lamp in said vertical array that is in horizontal alignment with each respective panel, whereby movement of any said panel will cause the switch associated therewith to momentarily close and thereby light the lamps in both vertical and horizontal alignment with that panel.

* * * * *